US005234187A

United States Patent [19]

Teppo et al.

[11] Patent Number: 5,234,187

[45] Date of Patent: Aug. 10, 1993

[54] CHAIR HEIGHT ADJUSTMENT MECHANISM

[75] Inventors: David S. Teppo, Grand Rapids; Russell T. Holdredge, Alto, both of Mich.

[73] Assignee: Steelcase Inc., Grand Rapids, Mich.

[21] Appl. No.: 892,353

[22] Filed: Jun. 2, 1992

[51] Int. Cl.[5] ..... F16M 11/00

[52] U.S. Cl. ..... 248/161; 248/422

[58] Field of Search ..... 248/161, 157, 404, 422; 297/345; 267/64.12

[56] References Cited

U.S. PATENT DOCUMENTS

| | | | |
|---|---|---|---|
| 367,840 | 8/1887 | Parker . | |
| 831,994 | 9/1906 | Rudman | 248/161 X |
| 1,379,943 | 5/1921 | Stevens . | |
| 1,725,329 | 8/1929 | Blandford | 248/404 X |
| 1,888,136 | 11/1932 | McDermott . | |
| 3,143,332 | 8/1964 | Watlington . | |
| 3,339,873 | 9/1967 | Hale . | |
| 3,381,926 | 5/1968 | Fritz et al. . | |
| 3,675,597 | 7/1972 | Oddsen et al. . | |
| 3,711,054 | 1/1973 | Bauer . | |
| 3,777,617 | 12/1973 | Okiyama . | |
| 3,788,587 | 1/1974 | Stemmler . | |
| 3,861,740 | 1/1975 | Tajima et al. . | |
| 3,891,270 | 6/1975 | Crossman et al. . | |
| 3,921,952 | 11/1975 | Wirges . | |
| 4,072,288 | 2/1978 | Wirges et al. . | |
| 4,113,220 | 9/1978 | Godwin et al. . | |
| 4,139,175 | 2/1979 | Bauer . | |
| 4,183,689 | 1/1980 | Wirges et al. . | |
| 4,220,307 | 9/1980 | Hale . | |
| 4,245,826 | 1/1981 | Wirges . | |
| 4,247,068 | 1/1981 | Edelson et al. . | |
| 4,415,135 | 11/1983 | French . | |
| 4,445,671 | 5/1984 | Reuschenbach et al. . | |
| 4,465,266 | 8/1984 | Hale . | |
| 4,485,996 | 12/1984 | Beukema et al. . | |
| 4,580,749 | 4/1986 | Howard . | |
| 4,592,590 | 5/1986 | Slaats et al. . | |
| 4,593,951 | 6/1986 | Slaats et al. . | |
| 4,595,237 | 6/1986 | Nelsen . | |
| 4,613,106 | 9/1986 | Tornero . | |
| 4,621,868 | 11/1986 | Slaats et al. . | |
| 4,627,602 | 12/1986 | Spork | 248/161 X |
| 4,651,652 | 3/1987 | Wyckoff . | |
| 4,673,155 | 6/1987 | Binder . | |
| 4,692,057 | 9/1987 | Lauderbach . | |
| 4,709,894 | 12/1987 | Knoblock et al. . | |
| 4,720,068 | 1/1988 | Tornero . | |
| 4,756,496 | 7/1988 | Hosan et al. . | |
| 4,807,836 | 2/1989 | Price et al. . | |
| 4,844,392 | 7/1989 | Bauer et al. . | |
| 4,899,969 | 2/1990 | Bauer et al. . | |
| 4,940,202 | 7/1990 | Hosan et al. . | |
| 4,969,619 | 11/1990 | Bauer et al. . | |
| 4,979,718 | 12/1990 | Bauer et al. . | |
| 4,997,150 | 3/1991 | Mardollo . | |
| 5,012,996 | 5/1991 | Poertzgen et al. . | |
| 5,078,351 | 1/1992 | Gualtieri . | |
| 5,114,109 | 5/1992 | Fitz et al. | 248/161 X |

FOREIGN PATENT DOCUMENTS

| | | |
|---|---|---|
| 0483806A1 | 5/1992 | European Pat. Off. . |
| 1529723 | 3/1977 | Fed. Rep. of Germany . |
| 2816761A1 | 10/1979 | Fed. Rep. of Germany . |
| 3604397A1 | 11/1986 | Fed. Rep. of Germany . |
| 4034633A1 | 5/1992 | Fed. Rep. of Germany . |
| 523675 | 7/1972 | Sweden . |

OTHER PUBLICATIONS

Lift-O-Mat Literature.

*Primary Examiner*—Ramon O. Ramirez

*Attorney, Agent, or Firm*—Price, Heneveld, Cooper, DeWitt & Litton

[57] ABSTRACT

An adjustment mechanism for adjusting the height of a chair seat, table top or other item includes telescoping outer, intermediate and inner tubes. The outer tube is attached to a base. The inner tube is attached to a chair seat or other load. A drive extends the telescoping tubes to adjust the height of the load. In one form, the drive includes a flexible, substantially nonelastic tape having an end fixed to the inner tube and an end fixed to the outer tube. The tape engages or rides over a sheave supported on the intermediate tube. In another form, the drive includes a pair of racks and a pinion. A piston cylinder actuator is disposed within the inner tube. The actuator includes an extensible rod which causes relative movement between the inner and intermediate tubes and extension of the intermediate tube relative to the base through the drive tape or rack and pinion.

35 Claims, 3 Drawing Sheets

CHAIR HEIGHT ADJUSTMENT MECHANISM

BACKGROUND OF THE INVENTION

The present invention relates to actuators and more particularly to height adjustment mechanisms for furniture and other articles.

Various forms of telescoping actuators are presently available for supporting a load and adjusting the position of the load relative to a base. In furniture applications, such actuators may be used with chairs, tables, work surfaces and the like. Currently available actuators include hydraulic, pneumatic, pressurized gas or mechanical adjusters. Available structures may have a limited range of motion. Many suffer from excess complexity.

In the seating area, actuators or support columns are used to set the vertical height of the seat to adjust the seating to the user and/or the task. Currently available actuators include weight actuated height adjusters of the type disclosed in commonly owned U.S. Pat. No. 4,709,894 entitled SLIP CONNECTOR FOR WEIGHT ACTUATED HEIGHT ADJUSTERS, which issued on Dec. 1, 1987 to Knoblock et al. The adjuster disclosed therein is functional when the seat is unoccupied. The actuator disengages when the seat is occupied to permit the seat to swivel on the base without an effect on the seat height. Examples of pneumatic or gas spring adjustment mechanisms may be found in U.S. Pat. No. 5,078,351 entitled ADJUSTABLE LENGTH CYLINDER SUPPORT PILLAR FOR CHAIR SEAT, which issued on Jan. 7, 1992 to Gualtieri and U.S. Pat. No. 4,580,749 entitled SUPPORT COLUMN UNIT, which issued on Apr. 8, 1986 to Howard.

Available height adjustment mechanisms have limited travel range. Currently available seat actuators are not capable of raising the seat height from a standard seated use position to a standing use position. Currently available mechanisms cannot be modified to provide increased travel while maintaining a compact configuration and smooth and quiet operation. A need, therefore, exists for an improved actuator capable of adjusting the positioning of a load and which may be readily incorporated into existing articles such as furniture.

SUMMARY OF THE INVENTION

In accordance with the present invention, the aforementioned need is fulfilled. Essentially, a telescoping adjustment mechanism is provided including an outer tube, an intermediate tube and an inner tube. An extendable and retractable actuator is positioned within the inner tube. The actuator includes relatively moveable elements connected to the inner tube and the intermediate tube. A drive interconnects the tubes so that relative motion between the inner and intermediate tubes raises and lowers the intermediate tube with respect to the outer tube.

In one form, the drive includes an elongated substantially nonelastic tape and a sheave member. The sheave member is connected to an end of the intermediate tube. The tape extends over the sheave member. The tape has an end fixed to the inner tube and another end fixed to the outer tube. In another form of the drive, a pinion is mounted on the intermediate tube. The pinion engages gear racks on the inner and outer tubes.

In the preferred form, the actuator is a pneumatic or gas spring including a cylinder and an extensible rod.

The tape extends downwardly from the inner tube over the sheave on the intermediate tube and then upwardly to an attachment point adjacent the upper end of the outer tube. The outer tube is connectable to a pedestal or the like. The inner tube is connectable to a chair seat or other load. Sleeve-like bearings may be positioned between the inner tube, intermediate tube and the outer tube. In addition, provision may be made for permitting the inner tube to rotate or swivel when the adjustment mechanism is incorporated into a chair or other seating product.

The adjustment mechanism in accordance with the present invention provides a one-to-two travel rate, that is, for every inch of travel of the gas spring a two inch travel of the inner tube with respect to the outer tube results. The mechanism permits a chair to function as a dual purpose sit or stand chair. The mechanism is compact and simple in construction. The mechanism provides smooth, quiet and reliable operation. Shock loads are readily absorbed by compression of the gas cylinder in the actuator. The mechanism is readily adaptable to or incorporated in existing articles.

DETAILED DESCRIPTION OF THE PREFERRED EMBODIMENT

Figure 1:
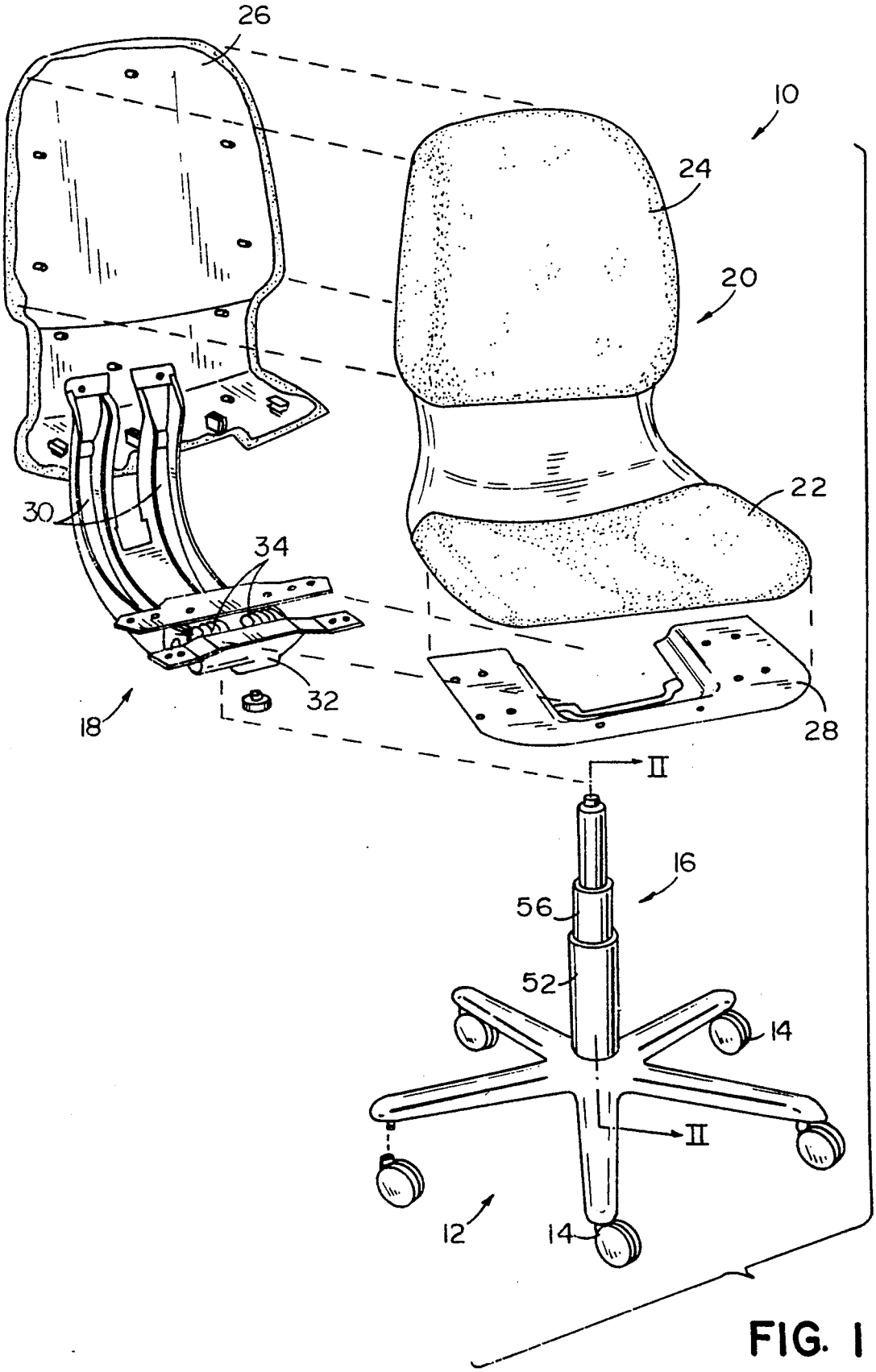
FIG. 1 is an exploded, perspective view of a chair incorporating the adjustment mechanism in accordance with the present invention.

A chair incorporating a height adjustment mechanism in accordance with the present invention is illustrated in FIG. 1 and generally designated by the numeral 10. Chair 10 includes a base or pedestal 12 which may be supported on castors 14. A height adjustment mechanism 16 in accordance with the present invention is mounted on base 12. A conventional chair control mechanism 18 is mounted on the adjustment mechanism 16. A seat shell 20 including a seat portion 22 and a back portion 24 is secured to the chair control 18. Seat shell pieces 26 and 28 are attached to the back side of back portion 28 and the bottom of seat portion 22, respectively. Chair control mechanism 18 includes back uprights 30. Uprights 30 are pivoted to a control housing 32. Uprights 30 tilt rearwardly against the bias of torsion springs 34. Control 18 and chair shell 20 may be of the type disclosed, for example, in commonly owned U.S. Pat. No. 4,744,603 entitled CHAIR SHELL WITH SELECTIVE BACK STIFFENING, which issued on May 17, 1988 to Knoblock. To the extent necessary, the disclosure of such patent is hereby incorporated by reference.

Figure 2:
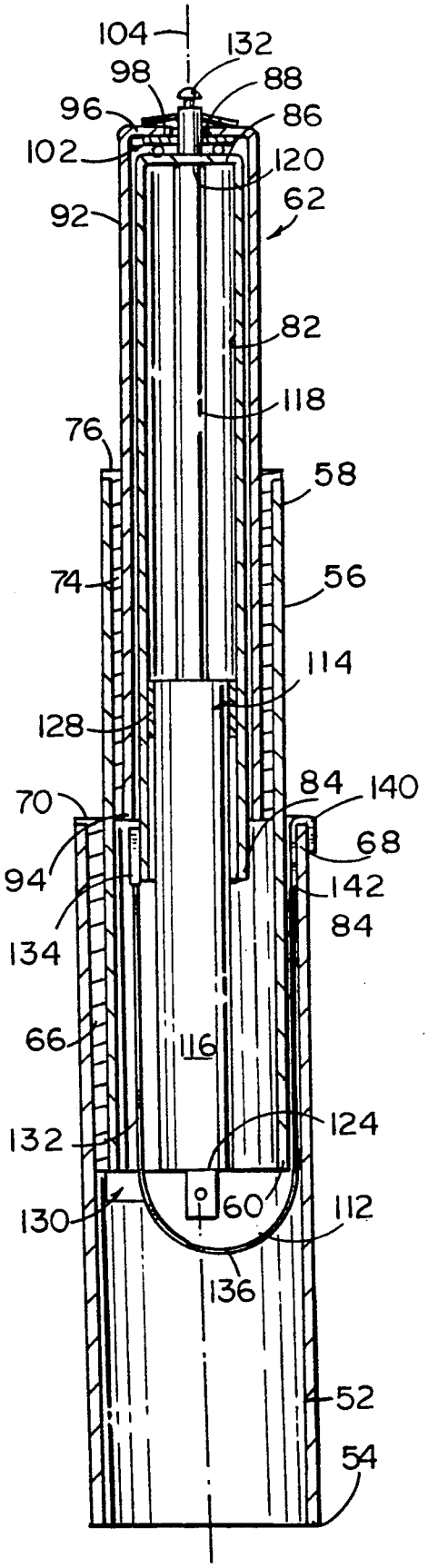
FIG. 2 is a cross-sectional view of the adjustment mechanism taken generally along lines II—II of FIG. 1.
Figure 3:
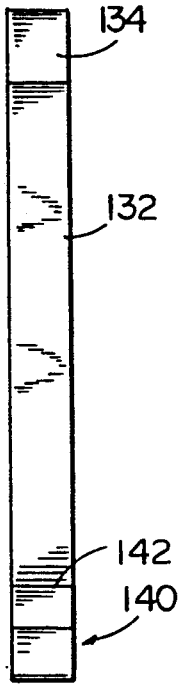
FIG. 3 is a fragmentary, plan view of the tape or ribbon incorporated in the present invention.

As best seen in FIGS. 2 and 3, adjuster mechanism 16 includes an outer, generally elongated tube or base 52. Base 52 may be circular or rectangular in cross section. A lower end 54 of base 52 is mounted on pedestal 12. Base 52 telescopingly receives a middle column or intermediate tube 56. Tube 56 includes an open upper end 58 and a lower end 60. An inner tube assembly or elongated extend column assembly 62 is telescopingly received within middle column or tube 56. As best seen in FIG. 2, an elongated, tubular sleeve bearing 66 is press-fitted into the open upper end 68 of base 52. Bearing 66 includes an upper peripheral flange 70 which engages upper end 68. Similarly, an elongated, sleeve bearing 74 is press-fitted or received within intermediate or middle tube 56. Bearing 74 similarly includes an upper flange 76 which engages upper end 58 of tube 56. Bearing 74 is positioned between an inner wall of tube 56 and the extend column 62.

Assembly 62 includes an extend column bearing tube 82. Tube 82 includes an open lower end 84 and a closed or cup-like upper end 86. Extend column 62 also includes a tube 92. Member 92 includes an open lower end 94 and a cup-like or closed upper end 96. End 96 defines an aperture 98. A rotary ball or thrust bearing assembly 102 is positioned between ends 86, 88 of tubes 82, 92. Tube 92 can, therefore, rotate about a vertical axis 104 with respect to tube 82.

A curved sheave or fixed pulley-like member 112 is secured to lower end 60 of middle tube or column 56. An actuator 114 is positioned within tube 82. The actuator extends between upper end 86 of tube 82 and sheave 112. In the preferred form, actuator 114 is a gas or pneumatic spring which includes a cylinder 116 and an extendable and retractable rod 118. Rod 118 includes a stepped end 120 which engages and is connected to cup portion 86 of tube 82. Cylinder 116 includes an end 124 secured to sheave 112. A key ring 128 may also be positioned around cylinder 116 to engage a key slot formed in an inner surface of tube 82. The key ring prevents rotation of the cylinder with respect to the inner tube. Spring 114 also includes a release button 132 which extends from an upper end of rod 120. When button 132 is depressed, rod 118 may be positioned with respect to cylinder 114. When the button is released, actuator 114 operates as a gas spring. Shock loads applied to the upper end of column assembly 62 are absorbed by compression of the gas within cylinder 116. A standard actuator lever mounted on the chair control, for example, may be included to depress button 132. Actuator 114 is a conventional item which has heretofore been used in height adjusters for furniture articles including chairs.

As shown in FIGS. 2 and 3, provision is made for translating motion of the inner tube or extend column assembly 62 with respect to intermediate tube 56 and to translate motion of intermediate tube 56 with respect to the base 52. In the preferred form, a drive means 130 including an elongated tape or ribbon 132 is provided. Tape 132 has an upper end 134 fixed to a lower end 84 of inner tube 82. Tape 132 extends downwardly within intermediate tube 56 and over an outer surface 136 of sheave 112. Tape 132 then extends upwardly between outer tube 52 and intermediate or middle tube 56 to upper end 68 of the tube. Sleeve bearing 54 is slotted to receive the tape. The tape is attached to a hook 140 at an end 142. Hook 140 is positioned over end 68 of base tube 52. As relative movement occurs between cylinder 116 and piston rod 118, intermediate tube 56 and extend column assembly 62 extend outwardly or upwardly with respect to the base tube 52. For each inch of travel between members 116, 118, two inches of travel of the extend column 62 results. The use of the flat, elongated ribbon permits the three tube assembly to be compact in configuration and size.

In the preferred form, the ribbon is fabricated from 301 stainless steel. The ribbon has a width of three quarters of an inch and a thickness of seven thousandths of an inch. The ribbon is a flexible, force transmission member, which is substantially nonelastic. Movement of the piston rod is translated into movement of the intermediate and inner tubes with respect to the base tube through the flat ribbon. As inner tube assembly 62 is extended with respect to intermediate tube 56, tube 56 lifts out of outer tube 52. As inner tube assembly 62 retracts, intermediate tube 56 also retracts into the outer tube. The ribbon reduces the radius or diameter of sheave portion 112 over that required for a cable. The tape permits a compact configuration. A cable would require an increased diameter or radius of curvature for the sheave portion 112 to prevent kinking or excessive localized loading resulting in a bulky adjustment mechanism. In addition, cables tend to stretch when tensile loads are applied which would have an adverse effect on operation.

Figure 4:
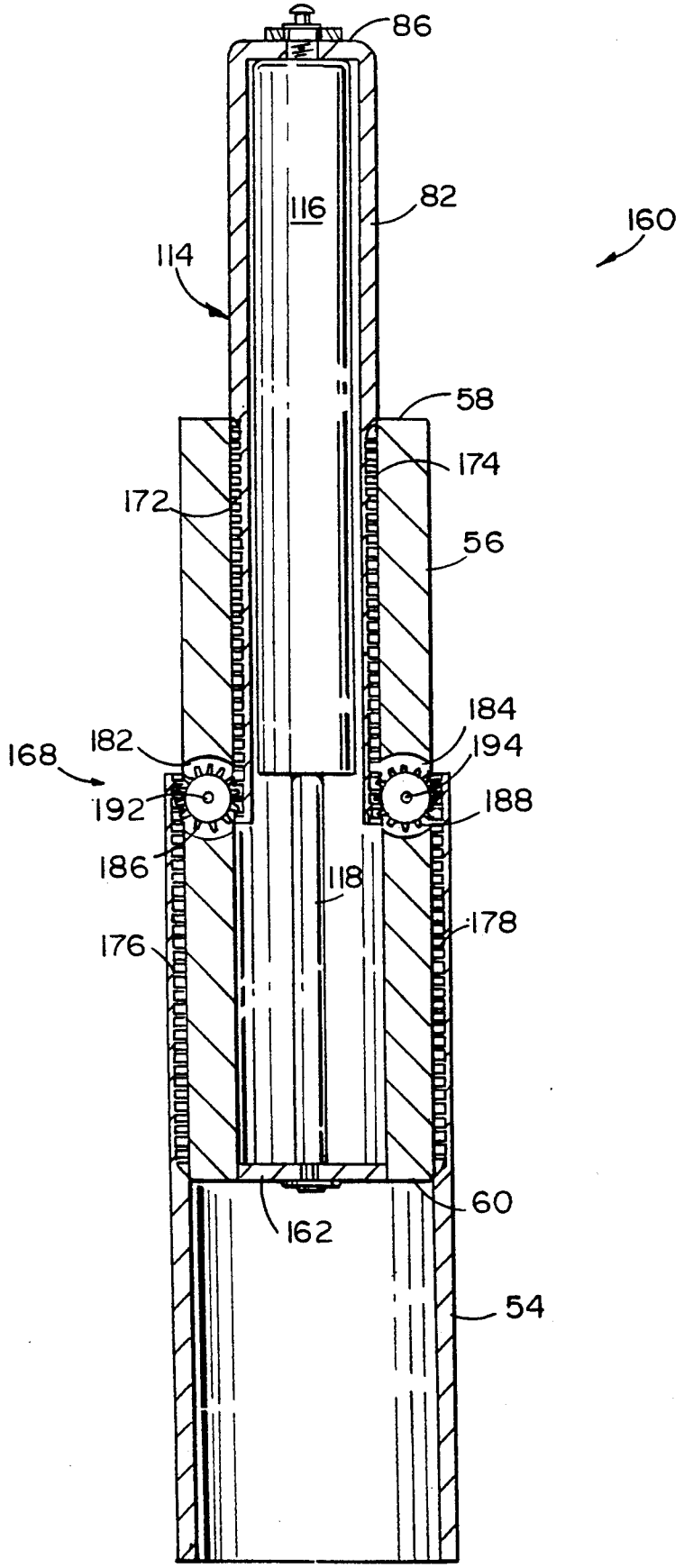
FIG. 4 is a cross-sectional view of an alternative embodiment of the present invention.

An alternative embodiment of the adjustment mechanism in accordance with the present invention is illustrated in FIG. 4 and generally designated by the numeral 160. Embodiment 160 similarly includes an outer tube 54, an intermediate tube or middle column 56 and an inner tube 82. Middle tube 56 includes an open upper end 58 and a lower end 60. A cross piece or closed end 162 is positioned or formed at end 60. As shown, lower end 60 of tube 56 may be closed or cup-shaped. A pneumatic or gas spring actuator 114 is also disposed within inner tube 82. Actuator 114 includes a cylinder 116, which is attached to end 86 of tube 82. An extendable and retractable piston rod 118 is attached to closed end 162 of tube 56. Extension and retraction of the piston rod from the cylinder causes extension and retraction of the inner tube with respect to middle tube 56.

An alternative drive, generally designated 168, interconnects the inner tube, middle tube and outer tube so that relative movement between the inner and middle tube translates into extension and retraction of middle tube 56 from the base tube 52. As shown, inner tube assembly 62 is provided with gear racks 172, 174. An inner surface of outer tube 52 is provided with gear racks 176, 178. Middle tube 56 defines slots 182, 184. Pinions or gears 186, 188 are rotatably mounting in slots 182, 184, respectively, by shafts 192, 194. Pinion 186 contacts racks 172, 174. Pinion 188 engages and contacts gear racks 176, 178. As inner tube 82 extends with respect to middle tube 56, the gear racks and pinions translate such motion through the middle tube to outer tube 52 so that middle tube 56 also extends with respect to the outer tube. Extension and retraction of actuator 114 causes the inner and middle tubes to extend and retract with respect to the outer or base tube 52. The rack and gear drive 160 translates relative motion between the tube to provide the same end result achieved through the flexible, nonelastic tape drive and sheave arrangement illustrated in FIGS. 2 and 3. Problems related to cable stretching, excessive localized loading and the like are also eliminated by the drive of FIG. 4.

The adjustment mechanism in accordance with the present invention is simple and results in reliable, quiet operation. The mechanism has a sufficient range of motion so that a dual purpose sit and stand chair is feasible with a conventional gas spring actuator. The mechanism allows for a lower seat height for a given height adjustment range than heretofore available. The retracted height can be reduced. Lower seat heights with increased height adjustment are important with the advent of adjustable height work surfaces. Available mechanisms can not adequately accommodate such adjustability or provide comfort for individuals who desire a lower seat height. The adjustment mechanism is readily incorporated into existing chair controls or other articles of furniture. It is also believed that the mechanism would have utility in areas other than chairs or furniture.

In view of the above description, those of ordinary skill in the art may envision various modifications which would not depart from the inventive concepts disclosed. For example, the rod of actuator 114 could be attached to the sheave and, hence, the intermediate tube with the cylinder attached to the inner tube. Positioning the actuator 114 within the inner tube significantly reduces the size and also maintains a compact configuration for the mechanism. It is expressly intended, therefore, that the above description should be considered as only that of the preferred embodiment. The true spirit and scope of the present invention may be determined by reference to the appended claims.

The embodiments of the invention in which an exclusive property or privilege is claimed are defined as follows:

1. A telescoping adjustment mechanism, comprising:
an outer tube;
an intermediate tube having upper and lower ends telescopingly received within said outer tube;
an inner tube having upper and lower ends telescopingly received within said intermediate tube;
drive means interconnecting said tubes for translating relative movement of said inner and intermediate tubes into relative movement between said intermediate and said outer tubes; and
actuator means within said inner tube and having relatively moveable elements connected to said inner tube and said intermediate tube for extending and retracting said inner and intermediate tube with respect to said outer tube.

2. A telescoping mechanism as defined by claim 1 wherein said drive means comprises:
a sheave member connected to one of said ends of said intermediate tube; and
an elongated, flexible substantially nonelastic tape member extending over said sheave member and having a first end fixed to said inner tube and a second end fixed to said outer tube.

3. A telescoping mechanism as defined by claim 2 wherein said sheave member is connected to the lower end of said intermediate tube.

4. A telescoping mechanism as defined by claim 3 wherein said tape extends from said first end thereof downwardly and over said sheave member and then upwardly between said intermediate tube and said outer tube with said second end thereof fixed adjacent the upper end of said outer tube.

5. A telescoping mechanism as defined by claim 4 further comprising an outer bearing between said intermediate tube and said outer tube.

6. A telescoping mechanism as defined by claim 5 further comprising an intermediate bearing between said intermediate tube and said inner tube.

7. A telescoping mechanism as defined by claim 2 wherein said actuator means comprises a piston/cylinder actuator including a cylinder and a piston rod extending from said cylinder, said cylinder and said rod comprising said relatively moveable elements.

8. A telescoping mechanism as defined by claim 7 wherein said cylinder is fixed to said sheave member and said rod is fixed to said inner tube.

9. A telescoping mechanism as defined by claim 2 further including an outer extend column tube having an open lower end and an upper cup-like end, said inner tube being inserted within said extend column tube.

10. A telescoping mechanism as defined by claim 9 further including a rotary bearing positioned between said cup-like end of said extend column tube and said upper end of said inner tube so that said extend column tube can rotate with respect to said outer tube.

11. A telescoping mechanism as defined by claim 10 wherein said actuator means comprises a gas spring including a cylinder and a piston rod extending from said cylinder, said cylinder and said rod comprising said drive elements.

12. A telescoping mechanism as defined by claim 11 wherein said cylinder is fixed to said sheave member and said rod is fixed to said inner tube.

13. A telescoping mechanism as defined by claim 11 wherein said sheave member is connected to the lower end of said intermediate tube.

14. A telescoping mechanism as defined by claim 13 wherein said tape extends from said first end thereof downwardly and over said sheave member and then upwardly between said intermediate tube and said outer tube with said second end thereof fixed adjacent the upper end of said outer tube.

15. A telescoping mechanism as defined by claim 14 further comprising an outer bearing between said intermediate tube and said outer tube.

16. A telescoping mechanism as defined by claim 15 further comprising an intermediate bearing between said intermediate tube and said inner tube.

17. A telescoping mechanism as defined by claim 1 wherein said drive means comprises:
a rack on an inner surface of said outer tube;
another rack on an outer surface of said inner tube; and
a pinion rotatably mounted on said intermediate tube and engaging said racks so that relative movement of said inner tube with respect to said intermediate tube translates into relative movement between said intermediate tube and said outer tube.

18. A telescoping mechanism as defined by claim 17 wherein said actuator means comprises a piston/cylinder actuator including a cylinder and a piston rod extending from said cylinder, said cylinder and said rod comprising said drive elements.

19. A telescoping mechanism as defined by claim 18 wherein said cylinder is fixed to said inner tube and said piston rod is connected to said intermediate tube.

20. A height adjustment mechanism for a chair, said mechanism comprising:
an elongated, generally tubular base;
an elongated middle column telescopingly received within said base;
an elongated extend column telescopingly received within said middle column; and
extension and retraction drive means interconnecting said base, said middle column and said extend column for extending and retracting said intermediate column and said extend column with respect to said base, said drive means including means for transmitting relative motion of said extend and middle columns to relative motion of said middle column and said tubular base.

21. A height adjustment mechanism as defined by claim 20 wherein said extension and retraction means includes:

an elongated, flexible and substantially nonelastic force transmission member engaging said middle column and having an end connected to said extend column and another end connected to said base.

22. A height adjustment mechanism as defined by claim 21 wherein said drive means further comprises a sheave defining a curved outer surface, said sheave being connected to a lower end of said middle column.

23. A height adjustment mechanism as defined by claim 22 wherein said force transmission member is an elongated ribbon which rides on said curved outer surface of said sheave.

24. A height adjustment mechanism as defined by claim 23 wherein said ribbon extends downwardly from said extend column over said sheave and upwardly between said middle column and said base.

25. A height adjustment mechanism as defined by claim 24 wherein said drive means further includes an actuator having first and second members, each connected to one of said middle and extend columns.

26. A height adjustment mechanism as defined by claim 24 wherein said drive means further includes a piston/cylinder actuator having a cylinder and a piston rod each connected to one of said middle and extend columns.

27. A height adjustment mechanism as defined by claim 26 wherein said cylinder is connected to said middle column and said rod is connected to said extend column.

28. A height adjustment mechanism as defined by claim 26 wherein said extend column includes an inner tube within which said actuator is positioned, an outer extend column tube receiving said inner tube and a rotary bearing between said inner tube and said outer extend column tube.

29. A height adjustment mechanism as defined by claim 28 further including a base sleeve bearing between said base and said middle column.

30. A height adjustment mechanism as defined by claim 29 further including a middle sleeve bearing between said middle column and said extend column.

31. A height adjustment mechanism as defined by claim 30 wherein said piston/cylinder actuator is a gas spring.

32. A height adjustment mechanism as defined by claim 20 wherein said extension and retraction means comprises:

a rack on said base;

another rack on said extend column; and a pinion rotatably mounted on said middle column, said pinion engaging said racks.

33. A height adjustment mechanism as defined by claim 32 wherein said drive means further includes a piston/cylinder actuator having a cylinder and a piston rod each connected to one of said middle and extend columns.

34. A height adjustment mechanism as defined by claim 33 wherein said cylinder is connected to said extend column and said rod is connected to said middle column.

35. A height adjustment mechanism as defined by claim 34 wherein said piston/cylinder actuator is a gas spring.

* * * * *